US006504353B2

(12) United States Patent
Kobayashi et al.

(10) Patent No.: US 6,504,353 B2
(45) Date of Patent: Jan. 7, 2003

(54) DRIVE POWER SUPPLYING METHOD FOR SEMICONDUCTOR MEMORY DEVICE AND SEMICONDUCTOR MEMORY DEVICE

(75) Inventors: Isamu Kobayashi, Kasugai (JP); Yoshiharu Kato, Kasugai (JP)

(73) Assignee: Fujitsu Limited, Kawasaki (JP)

( * ) Notice: Subject to any disclaimer, the term of this patent is extended or adjusted under 35 U.S.C. 154(b) by 67 days.

(21) Appl. No.: 09/772,075

(22) Filed: Jan. 30, 2001

(65) Prior Publication Data

US 2001/0010459 A1 Aug. 2, 2001

(30) Foreign Application Priority Data

Jan. 31, 2000 (JP) ..... 2000-022151

(51) Int. Cl.[7] ..... G05F 1/40
(52) U.S. Cl. ..... 323/314
(58) Field of Search ..... 323/312–315; 327/535, 538, 544; 365/226–229; 713/300

(56) References Cited

U.S. PATENT DOCUMENTS 5,461,338 A * 10/1995 Hirayama et al. ..... 327/534
6,021,082 A * 2/2000 Shirai ..... 365/226
6,351,179 B1 * 2/2002 Ikehashi et al. ..... 327/541
6,385,119 B2 * 2/2002 Kobayashi et al. ..... 365/227

* cited by examiner

*Primary Examiner*—Matthew Nguyen
(74) *Attorney, Agent, or Firm*—Arent Fox Kintner Plotkin & Kahn, PLLC

(57) ABSTRACT

A drive power supply method for a semiconductor device is provided. The semiconductor device has an internal supply voltage generating circuit. First and second internal circuits are connected to the internal supply voltage generating circuit. Drive power is supplied to the first and second internal circuits from the internal supply voltage generating circuit. The second internal circuit operates in standby mode, power-down mode and active mode, so that the internal supply voltage is stably retained in the standby mode or power-down mode, and the consumed current is reduced.

13 Claims, 4 Drawing Sheets

DRIVE POWER SUPPLYING METHOD FOR SEMICONDUCTOR MEMORY DEVICE AND SEMICONDUCTOR MEMORY DEVICE

BACKGROUND OF THE INVENTION

The present invention relates to a semiconductor device including a semiconductor memory device and, more particularly, to a semiconductor device having an internal supply voltage generating circuit that provides internal circuits with an internal supply voltage.

A semiconductor memory device has two internal supply voltage generating circuits for generating internal supply voltages supplied to the individual internal circuits in order to reduce the consumed current in standby mode and self-refresh mode. The first internal supply voltage generating circuit (voltage-drop circuit for large power, which will hereinafter be referred to as "large-power voltage-drop circuit") consumes a relatively large current and supplies relatively large drive power. The second internal supply voltage generating circuit (voltage-drop circuit for small power, which will hereinafter be referred to as "small-power voltage-drop circuit") consumes a relatively small current and supplies relatively small drive power. In the active mode of the semiconductor memory device, the first and second internal supply voltage generating circuits operate to supply internal supply voltages to the individual internal circuits. In standby mode or power-down mode, the first internal supply voltage generating circuit stops operating and the second internal supply voltage generating circuit alone operates to supply the internal supply voltage to the individual internal circuits. The operation of only the second internal supply voltage generating circuit reduces the consumed power of the semiconductor memory device.

In standby mode or power-down mode, when current stops flowing in all of the internal circuits (load circuits), which are connected to the first and second internal supply voltage generating circuits via power lines, the potential of the power lines rises as a result of the transistor characteristic (sub-threshold characteristic) of the internal supply voltage generating circuits.

When the mode is changed from standby or power-down to active mode, an internal supply voltage exceeding a set value is supplied to the internal circuits, thereby altering the device characteristics. As a cell-plate voltage generating circuit or a self-refresh oscillation circuit connected to the power lines consumes power in standby mode or power-down mode, however, the rise in internal supply voltage is suppressed.

Because of various factors related to the microfabrication process, such as problems with maintaining voltage, excessive power consumption, power supply noise, the set level of the voltage-drop potential, and the use of external interfaces, there is a tendency to use separate internal supply voltage generating circuits for inputs and outputs, peripheral function circuits, and memory arrays. In such a configuration, without a load circuit (internal circuit)operating in standby mode or power-down mode and connected to the internal supply voltage generating circuit for inputs and outputs, the internal supply voltage rises.

If a load circuit is connected to the internal supply voltage generating circuits for the input/output circuits and the memory array, the load circuit stops operating in standby mode, causing the internal supply voltage to rise. In the case of a memory array, an internal circuit, such as a sense amplifier, generates a self-refresh in power-down mode.

However, the internal circuit, which has an operation time of tens of nanoseconds, operates only once in several tens of microseconds, on average. The operational ratio is therefore about 1/1000. As a result, the internal supply voltage rises.

A semiconductor memory device has been proposed that is designed to suppress an increase in internal supply voltage. In the device, a leak element (e.g., a resistor, MOS diode, or the like), which does not perform any of the intended functions of the semiconductor memory device, is connected to the power lines of each internal supply voltage generating circuit. A leak current of between several and several hundred $\mu$A continually flows through the leak element, so that a constant current is consumed even in standby mode or power-down mode. This suppresses a rise in internal supply voltage. However, because of the continual flow, consumed power in standby mode or power-down mode inevitably increases.

SUMMARY OF THE INVENTION

Accordingly, it is an object of the present invention to provide a semiconductor device that stably retains the internal supply voltage in standby mode or power-down mode and reduces the consumed current.

In a first aspect of the present invention, a drive power supply method for a semiconductor device is provided. The semiconductor device has an internal supply voltage generating circuit. First, first and second internal circuits are connected to the internal supply voltage generating circuit. The first internal circuit is inactivated in standby mode or power-down mode and is activated in active mode. The second circuit operates in the standby mode, the power-down mode and the active mode. Drive power is supplied to the first and second internal circuits from the internal supply voltage generating circuit.

In a second aspect of the present invention, a drive power supply method for a semiconductor device is provided. The semiconductor device has a plurality of internal supply voltage generating circuits, each including a first voltage-drop circuit for supplying relatively large drive power and a second voltage-drop circuit for supplying relatively small drive power. First, first and second internal circuit are connected to at least one of the plurality of internal supply voltage generating circuits. The first internal circuit is inactivated in standby mode or power-down mode and is activated in active mode. The second internal circuit operates in the standby mode, the power-down mode and the active mode. Next, drive power is supplied to the first and second internal circuits from at least the first voltage-drop circuit in the active mode. Drive power is supplied to the second internal circuit from at least the second voltage-drop circuit in the standby mode or the power-down mode.

In a third aspect of the present invention, a semiconductor device is provided that includes at least one internal supply voltage generating circuit for generating relatively small drive power in standby mode or power-down mode and generating relatively large drive power in active mode. A first internal circuit is activated and receives drive power from the at least one internal supply voltage generating circuit in the active mode and is inactivated in the standby mode or the power-down mode. A second internal circuit operates by receiving drive power from the at least one internal supply voltage generating circuit in the standby mode, the power-down mode and the active mode.

In a fourth aspect of the present invention, a semiconductor memory device is provided that includes at least one internal supply voltage generating circuit including a first voltage-drop circuit for generating relatively large drive power and a second voltage-drop circuit for generating relatively small drive power. A first internal circuit is activated and receives drive power from at least the first voltage-drop circuit of the at least one internal supply voltage generating circuit in active mode and is inactivated in standby mode or power-down mode. A normally-driven internal circuit operates by receiving drive power from the second voltage-drop circuit of the at least one internal supply voltage generating circuit in the standby mode, the power-down mode and the active mode.

In a fifth aspect of the present invention, a semiconductor memory device includes a plurality of internal supply voltage generating circuits, each including a first voltage-drop circuit for generating relatively large drive power and a second voltage-drop circuit for generating relatively small drive power. A plurality of first internal circuits, each of which is activated and receives drive power from at least the first voltage-drop circuit of the associated internal supply voltage generating circuit in active mode and is inactivated in standby mode or power-down mode. A plurality of second internal circuits operate by receiving drive power from the second voltage-drop circuits of the internal supply voltage generating circuits in the standby mode, the power-down mode and the active mode.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
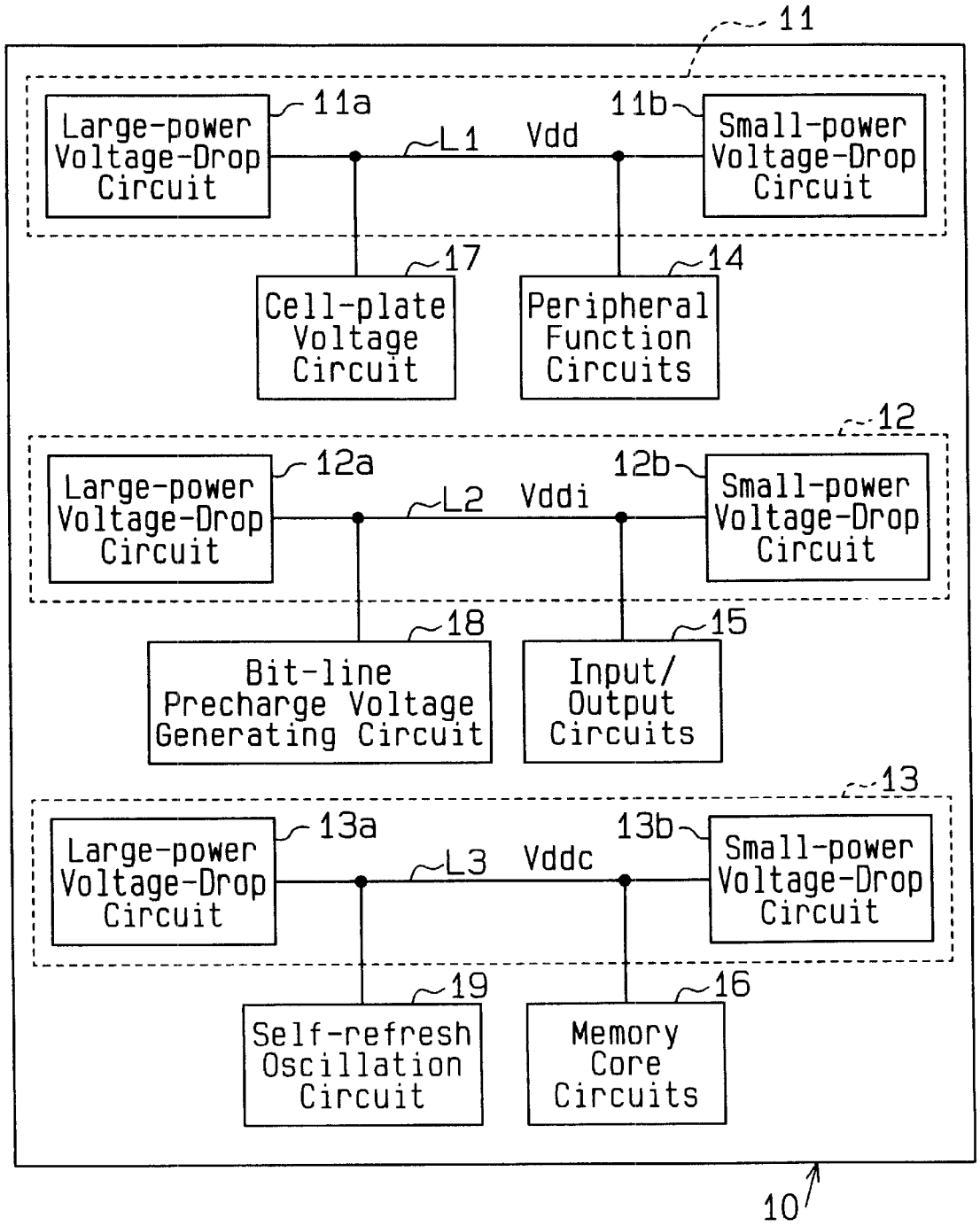
FIG. 1 is a schematic block circuit diagram of a semiconductor memory device according to one embodiment of the present invention.

A preferred embodiment of the present invention will now be described with reference to the accompanying drawings. A particular example of a semiconductor memory device, a synchronous DRAM (SDRAM) 10, contains internal supply voltage generating circuits according to the preferred embodiment.
according to As shown in FIG. 1, the SDRAM 10 is formed on a 1-chip semiconductor substrate and has a plurality (three in FIG. 1) of internal supply voltage generating circuits 11, 12 and 13. The first internal supply voltage generating circuit 11 generates a dropped supply voltage Vdd for peripheral circuits supplied to peripheral function circuits 14. The second internal supply voltage generating circuit 12 generates a dropped supply voltage Vddi for input/output circuits supplied to input/output circuits 15. The third internal supply voltage generating circuit 13 generates a dropped supply voltage Vddc for the memory core supplied to memory core circuits 16.

The input/output circuits 15 include a plurality of input circuits and output circuits, which constitute the input/output interface of the SDRAM 10. The individual input circuits and output circuits are activated or enabled in active mode and are inactivated or disabled in standby mode or power-down mode. The memory core circuits 16 include a sense amplifier and row and column decoders of the SDRAM 10. The individual memory core circuits 16 are enabled in active mode and are disabled in standby mode or power-down mode. The peripheral function circuits 14 include a plurality of peripheral circuits excluding the input/output circuits 15 and the memory core circuits 16. The individual peripheral function circuits 14 are enabled in active mode and are disabled in standby mode or power-down mode.

The internal supply voltage generating circuits 11, 12, and 13 have voltage-drop circuits 11*a*, 12*a*, and 13*a*, respectively, for large power (hereinafter referred to as "large-power voltage-drop circuits") and voltage-drop circuits 11*b*, 12*b*, and 13*b*, respectively, for small power (hereinafter referred to as "small-power voltage-drop circuits"). Each of the large-power voltage-drop circuits 11*a*, 12*a*, and 13*a* consumes a relatively large current and supplies relatively large drive power. Each of the small-power voltage-drop circuits 11*b*, 12*b*, and 13*b* consumes a relatively small current and supplies relatively small drive power.

Specifically, the large-power voltage-drop circuit 11*a* of the first internal supply voltage generating circuit 11 drops an external supply voltage Vext to generate the stable dropped supply voltage Vdd for peripheral circuits and supplies the dropped supply voltage Vdd to an internal power line L1. The small-power voltage-drop circuit 11*b* of the first internal supply voltage generating circuit 11 drops the external supply voltage Vext to generate the stable dropped supply voltage Vdd for peripheral circuits and supplies the dropped supply voltage Vdd to the internal power line L1.

The large-power voltage-drop circuit 12*a* of the second internal supply voltage generating circuit 12 drops the external supply voltage Vext to generate the stable dropped supply voltage Vddi for input/output circuits and supplies the dropped supply voltage Vddi to an internal power line L2. The small-power voltage-drop circuit 12*b* of the second internal supply voltage generating circuit 12 drops the external supply voltage Vext to generate the stable dropped supply voltage Vddi for input/output circuits and supplies the dropped supply voltage Vddi to the internal power line L2.

The large-power voltage-drop circuit 13*a* of the third internal supply voltage generating circuit 13 drops the external supply voltage Vext to generate the stable dropped supply voltage Vddc for the memory core and supplies the dropped supply voltage Vddc to an internal power line L3. The small-power voltage-drop circuit 13*b* of the third internal supply voltage generating circuit 13 drops the external supply voltage Vext to generate the stable dropped supply voltage Vddc for the memory core and supplies the dropped supply voltage Vddc to the internal power line L3.

When the SDRAM 10 is in active mode, the large-power voltage-drop circuits 11*a*, 12*a* and 13*a* and the small-power voltage-drop circuits 11*b*, 12*b* and 13*b* are enabled. The small-power voltage-drop circuits 11*b*, 12*b* and 13*b* may be disabled in active mode. When the SDRAM 10 is in standby mode or power-down mode, the large-power voltage-drop circuits 11*a*, 12*a* and 13*a* are disabled and the small-power voltage-drop circuits 11*b*, 12*b* and 13*b* are enabled.

In active mode, the peripheral function circuits 14 are enabled and receive the dropped supply voltage Vdd via the power line L1 from the large-power voltage-drop circuit 11*a* and the small-power voltage-drop circuit 11*b*. In standby mode or power-down mode, the peripheral function circuits 14, which are disabled in such a mode, are supplied with the dropped supply voltage Vdd via the power line L1 from the small-power voltage-drop circuit 11*b*.

In active mode, the input/output circuits 15 are enabled and receive the dropped supply voltage Vddi via the power line L2 from the large-power voltage-drop circuit 12*a* and the small-power voltage-drop circuit 12*b*. In standby mode or power-down mode, the input/output circuits 15, which are disabled in such a mode, are supplied with the dropped supply voltage Vddi via the power line L2 from the small-power voltage-drop circuit 12*b*.

In active mode, the memory core circuits 16 are enabled and receive the dropped supply voltage Vddc via the power line L3 from the large-power voltage-drop circuit 13*a* and the small-power voltage-drop circuit 13*b*. In standby mode or power-down mode, the memory core circuits 16, which are disabled in such a mode, are supplied with the dropped supply voltage Vddc via the power line L3 from the small-power voltage-drop circuit 13*b*.

Because the circuits 14, 15, and 16 are inactivated in standby mode or power-down mode and activated in the active mode, they are referred to as to-be-controlled internal circuits (first internal circuits).

A cell-plate voltage generating circuit 17 for memory cells is also connected to the internal power line L1. The cell-plate voltage generating circuit 17 is always enabled. In active mode, the cell-plate voltage generating circuit 17 operates on the dropped supply voltage Vdd, which is supplied from the large-power voltage-drop circuit 11*a* and the small-power voltage-drop circuit 11*b*. In standby mode or power-down mode, the circuit 17 operates on the dropped supply voltage Vdd, which is supplied from the small-power voltage-drop circuit 11*b*.

A bit-line precharge voltage generating circuit 18 is also connected to the internal power line L2. The bit-line precharge voltage generating circuit 18 is always enabled. In active mode, the bit-line precharge voltage generating circuit 18 operates on the dropped supply voltage Vddi, which is supplied from the large-power voltage-drop circuit 12*a* and the small-power voltage-drop circuit 12*b*. In standby mode or power-down mode, the circuit 18 operates on the dropped supply voltage Vddi, which is supplied from the small-power voltage-drop circuit 12*b*.

A self-refresh oscillation circuit 19 is also connected to the internal power line L3. The self-refresh oscillation circuit 19 is always enabled. In active mode, the self-refresh oscillation circuit 19 operates on the dropped supply voltage Vddc, which is supplied from the large-power voltage-drop circuit 13*a* and the small-power voltage-drop circuit 13*b*. In standby mode or power-down mode, the circuit 19 operates on the dropped supply voltage Vddc, which is supplied from the small-power voltage-drop circuit 13*b*.

Because the circuits 17, 18, and 19 operate in standby mode or power-down mode and the active mode, they are referred to as constantly-driven internal circuits (second internal circuits).

Circuits that normally generate DC current may be used in place of the cell-plate voltage generating circuit 17, the bit-line precharge voltage generating circuit 18, and the self-refresh oscillation circuit 19 that are respectively connected to the internal supply voltage generating circuits 11, 12, and 13. A load circuit, which constantly consumes current, may be connected to any voltage-drop circuit.

The third internal supply voltage generating circuit 13 is specifically discussed below. Because the first and second internal supply voltage generating circuits 11 and 12 have essentially the same structure as that of the third internal supply voltage generating circuit 13, their detailed descriptions are not repeated.

Figure 2:
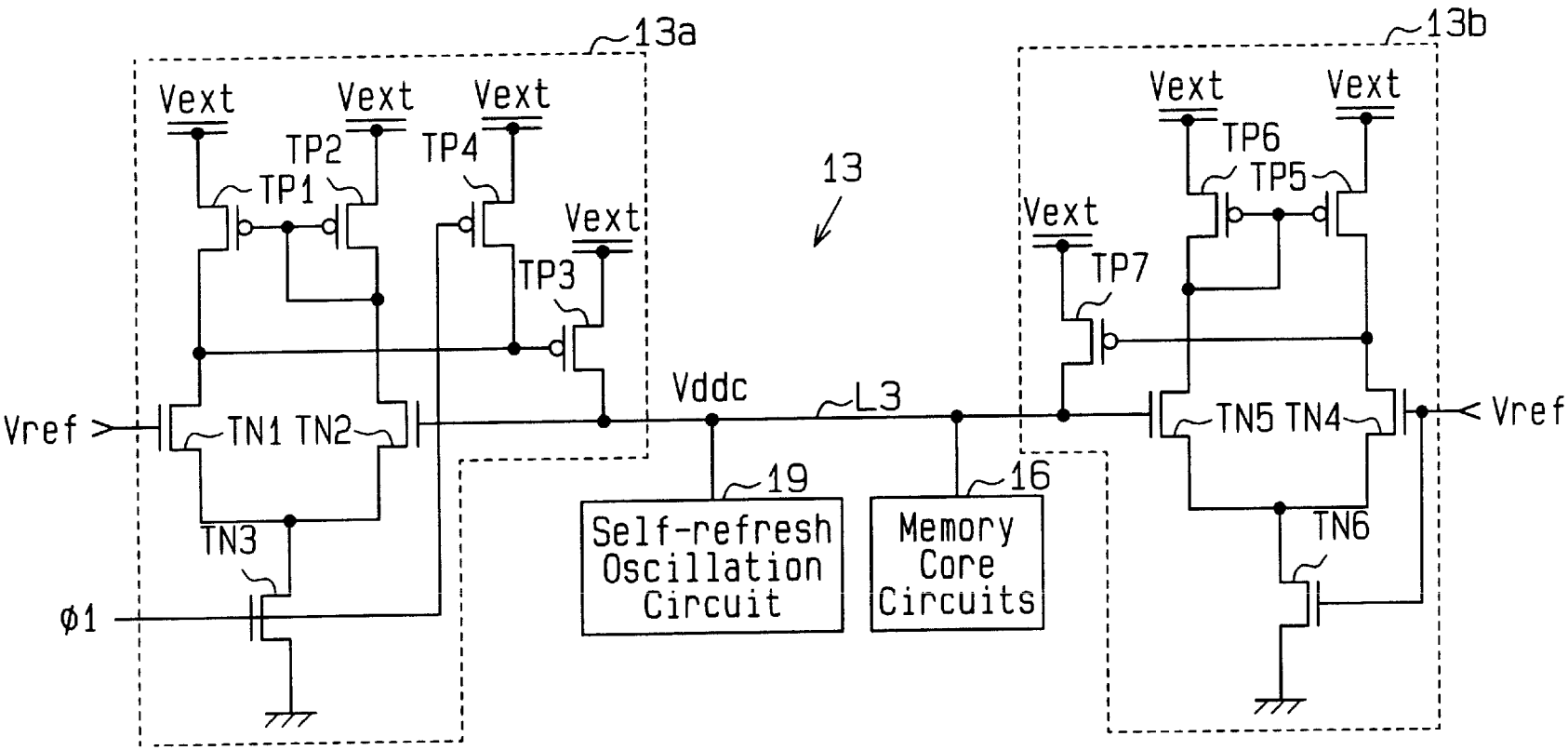
FIG. 2 is a schematic circuit diagram of an internal supply voltage generating circuit of the semiconductor memory device of FIG. 1.

As shown in FIG. 2, the large-power voltage-drop circuit 13*a*, which is preferably a differential amplifier, includes a differential amplification circuit that includes first and second N channel MOS (NMOS) transistors TN1 and TN2. The sources of the NMOS transistors TN1 and TN2 are grounded via a current control NMOS transistor TN3. An activation control signal $\phi$1 is supplied to the gate of the current control NMOS transistor TN3 so that the large-power voltage-drop circuit 13*a* is selectively enabled by the activation control signal The activation control signal $\phi$1 is generated by an activation signal generating circuit (not shown). The activation signal generating circuit sets the activation control signal $\phi$1 to a low level when the SDRAM 10 is in standby mode or power-down mode. The activation signal generating circuit sets the activation control signal $\phi$1 to a high level when the SDRAM 10 is changed to active mode from standby mode or power-down mode in response to an active command ACTV.

The drains of the NMOS transistors TN1 and TN2 are connected to the external supply voltage Vext via P channel MOS (PMOS) transistors TP1 and TP2. The gates of the PMOS transistors TP1 and TP2 are connected together to the drain of the second NMOS transistor TN2.

The gate (inverting input terminal) of the first NMOS transistor TN1 is supplied with a reference voltage Vref from a reference voltage generating circuit (not shown). The gate (non-inverting input terminal) of the second NMOS transistor TN2 is connected to the internal power line L3.

The drain of the first NMOS transistor TN1 is connected to the gate of a driving PMOS transistor TP3 such that the drain voltage of the first NMOS transistor TN1 is applied to the gate of the PMOS transistor TP3. The drain of the PMOS transistor TP3 is connected to the internal power line L3, and its source is connected to the external supply voltage Vext.

A PMOS transistor TP4 is connected between the gate of the driving PMOS transistor TP3 and the external supply voltage Vext. The gate of the PMOS transistor TP4 is supplied with the activation control signal $\phi$1.

The PMOS transistor TP3 is turned off by the low-level activation control signal $\phi$1, thereby disabling the large-power voltage-drop circuit 13*a* to block the supply of the dropped supply voltage Vddc to the internal power line L3. When the activation control signal $\phi$1 has a high level, the large-power voltage-drop circuit 13*a* is enabled and operates such that the voltage (i.e., the dropped supply voltage Vddc on the internal power line L3), which is supplied to the gate of the second NMOS transistor TN2, is substantially equal to the reference voltage Vref. That is, the dropped supply voltage Vddc is determined by the reference voltage Vref.

Figure 4:
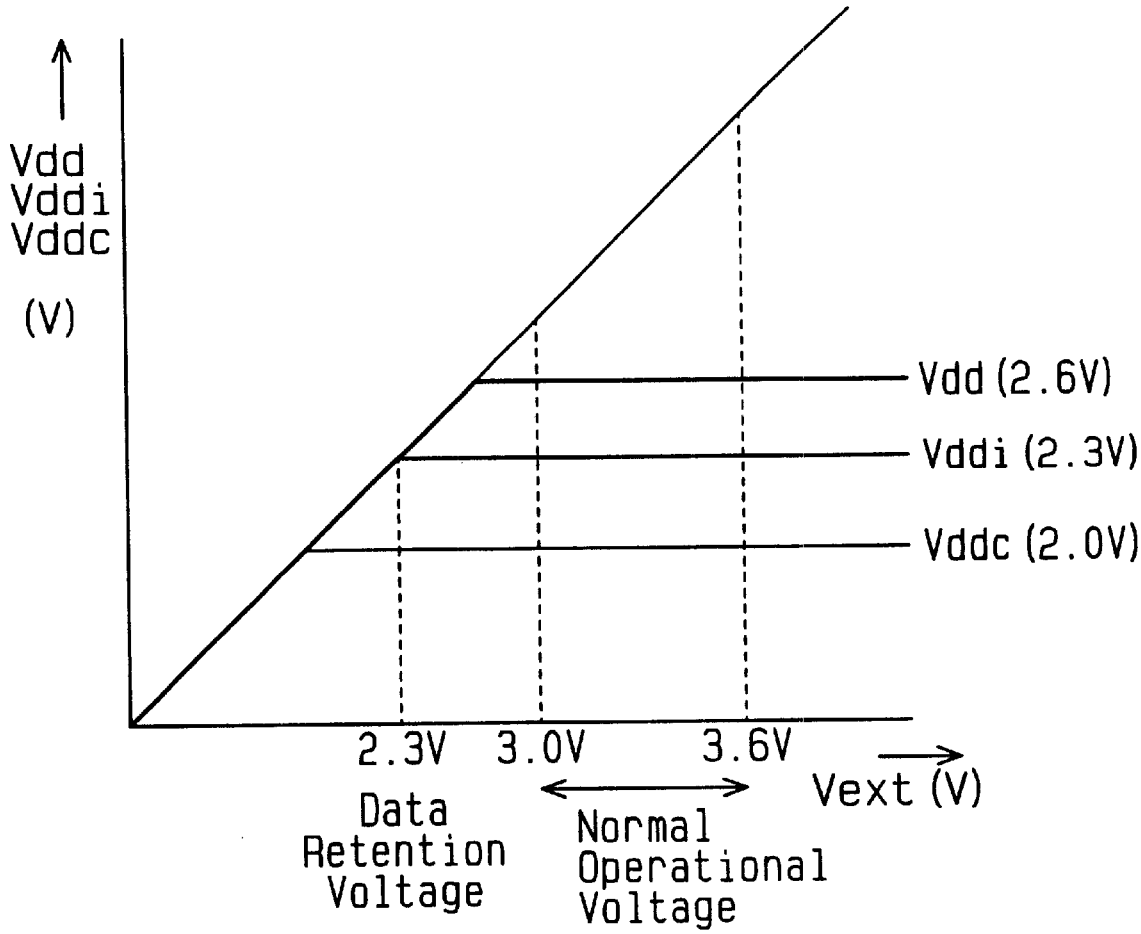
FIG. 4 is a graph showing the relationship between an external supply voltage and internal supply voltages that are generated by the internal supply voltage generating circuits.

Specifically, the large-power voltage-drop circuit 13*a* generates a dropped supply voltage Vddc that is constant with respect to the external supply voltage Vext and dependent on the reference voltage Vref. In other words, the large-power voltage-drop circuit 13*a* generates a dropped supply voltage Vddc of 2.0 V for the external supply voltage Vext, as shown in FIG. 4. Even when the external supply voltage Vext is less than a data retention voltage (e.g., 2.3 V), as well as when it lies within the normal operational voltage range of 3.0 V to 3.6 V, the large-power voltage-drop circuit 13*a* generates a dropped supply voltage Vddc of 2.0 V. The data retention voltage is a voltage in battery data retention mode, in which power consumption becomes low.

As shown in FIG. 4, the large-power voltage-drop circuit 11*a* of the first internal supply voltage generating circuit 11 generates a dropped supply voltage Vdd of 2.6 V for the external supply voltage Vext. The large-power voltage-drop circuit 12*a* of the second internal supply voltage generating circuit 12 generates the dropped supply voltage Vddi of 2.3 V with respect to the external supply voltage Vext. When the external supply voltage Vext drops to the data retention voltage, the dropped supply voltage Vdd and the dropped supply voltage Vddi of the large-power voltage-drop circuits 11*a* and 12*a* vary with the external supply voltage Vext. This is because the large-power voltage-drop circuit 13*a* generates the dropped supply voltage Vddc, which is lower than the dropped supply voltage Vdd and the dropped supply voltage Vddi.

The small-power voltage-drop circuit 13*b* (FIG. 2), which is preferably a differential amplifier, includes a differential amplification circuit that has first and second NMOS transistors TN4 and TN5. The sources of the NMOS transistors TN4 and TN5 are grounded via a current control NMOS transistor TN6. The gate of the current control NMOS transistor TN6 is connected to the gate of the first NMOS transistor TN4.

The drains of the NMOS transistors TN4 and TN5 are connected to the external supply voltage Vext via PMOS transistors TP5 and TP6. The gates of the PMOS transistors TP5 and TP6 are connected together to the drain of the second NMOS transistor TN5.

The gate (inverting input terminal) of the first NMOS transistor TN4 is supplied with the reference voltage Vref. Therefore, the small-power voltage-drop circuit 13*b* is always enabled. The gate (non-inverting input terminal) of the second NMOS transistor TN5 is connected to the internal power line L3.

The drain of the first NMOS transistor TN4 is connected to the gate of a driving PMOS transistor TP7 such that the drain voltage of the first NMOS transistor TN4 is applied to the gate of the PMOS transistor TP7. The drain of the PMOS transistor TP7 is connected to the internal power line L3, and its source is connected to the external supply voltage Vext.

The small-power voltage-drop circuit 13*b* operates such that the voltage (i.e., the dropped supply voltage Vddc on the internal power line L3), which is supplied to the gate of the second NMOS transistor TN5, is substantially equal to the reference voltage Vref.

The small-power voltage-drop circuit 13*b* generates a dropped supply voltage Vddc of 2.0 V for the external supply voltage Vext, as shown in FIG. 4. That is, the small-power voltage-drop circuit 13*b* generates the dropped supply voltage Vddc even when the external supply voltage Vext is less than the data retention voltage (e.g., 2.3 V), as well as when it lies within the normal operational voltage range of 3.0 V to 3.6 V.

The small-power voltage-drop circuit 11*b* generates a dropped supply voltage Vdd of 2.6 V for the external supply voltage Vext, as shown in FIG. 4. The small-power voltage-drop circuit 12*b* generates a dropped supply voltage Vddc of 2.3 V for the external supply voltage Vext. When the external supply voltage Vext drops to the data retention voltage, the dropped supply voltage Vdd and the dropped supply voltage Vddi vary with the external supply voltage Vext.

Although the large-power voltage-drop circuit 13*a* and the small-power voltage-drop circuit 13*b* generate the same dropped supply voltage Vddc, they differ from each other in drive power. That is, the size of the PMOS transistor TP3 of the large-power voltage-drop circuit 13*a* is larger than the size of the PMOS transistor TP7 of the small-power voltage-drop circuit 13*b*.

Figure 3:
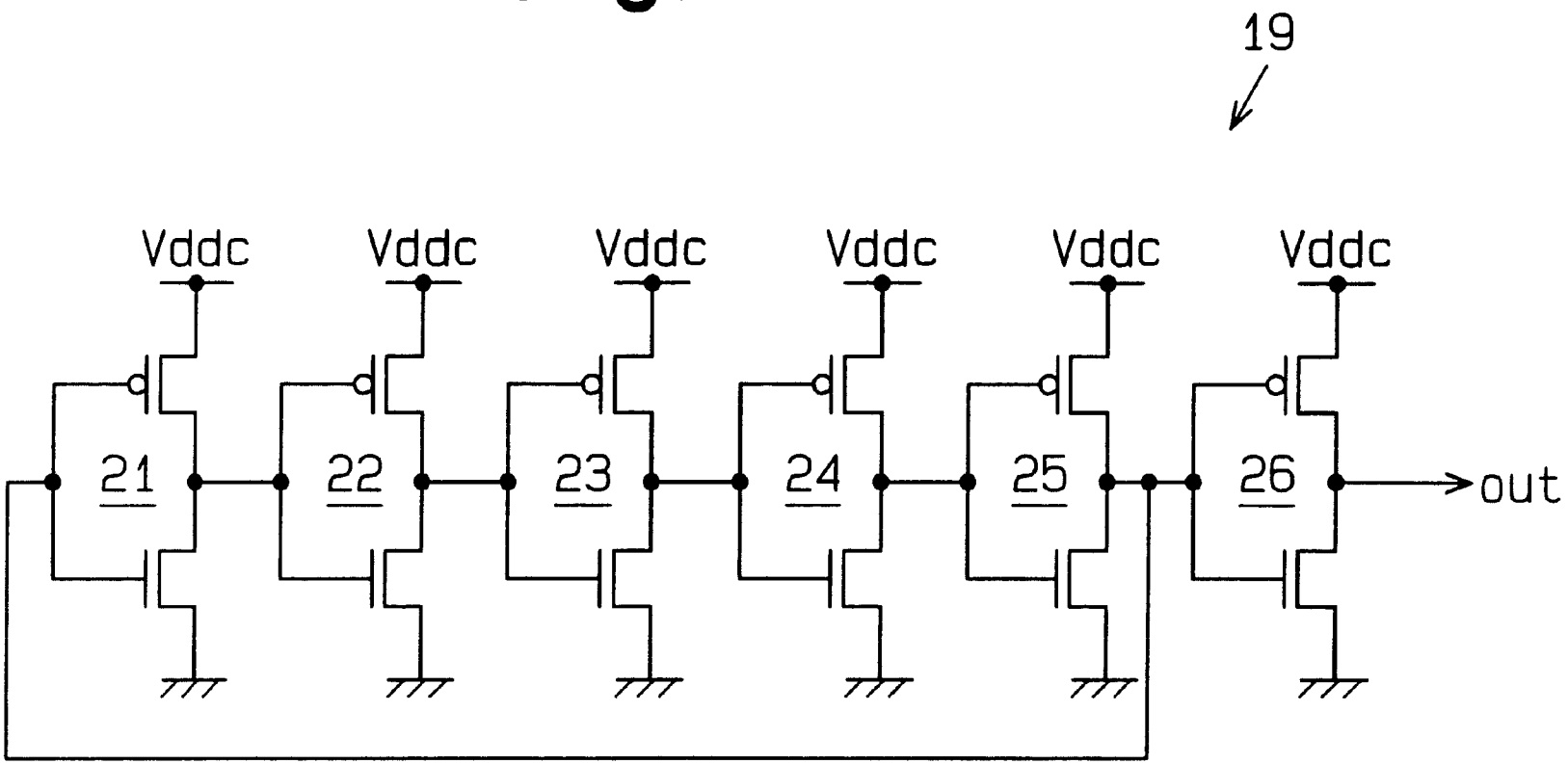
FIG. 3 is a schematic circuit diagram of a self-refresh oscillation circuit of the semiconductor memory device of FIG. 1.

As shown in FIG. 3, the self-refresh oscillation circuit 19, which is connected to the internal power line L3, includes an oscillation section with an odd number (five in this example) of inverter circuits 21 to 25 and an output section with a single inverter circuit 26. Each of the inverter circuits 21–25 includes a CMOS transistor and receives the dropped supply voltage Vddc via the internal power line L3. The five inverter circuits 21–25 are connected in series such that the output terminal of the last inverter circuit 25 is connected to the input terminal of the first inverter circuit 21. The closed loop connection of the five inverter circuits 21–25 generates an oscillation signal that is supplied to the inverter circuit 26.

The inverter circuit 26, which includes a CMOS transistor, receives the dropped supply voltage Vddc via the internal power line L3. The inverter circuit 26 inverts the oscillation signal to generate a refresh clock signal.

The SDRAM 10 of the preferred embodiment has the following advantages:

(1) The peripheral function circuits 14 and the cell-plate voltage generating circuit 17 are connected to the first internal supply voltage generating circuit 11. In standby mode or power-down mode, the drive power that is supplied from the small-power voltage-drop circuit 11*b* is consumed by the cell-plate voltage generating circuit 17. In standby mode or power-down mode, therefore, the drive power of the small-power voltage-drop circuit 11*b* is consumed, thereby suppressing a rise in dropped supply voltage Vdd for the peripheral circuits.

(2) The input/output circuits 15 and the bit-line precharge voltage generating circuit 18 are connected to the second internal supply voltage generating circuit 12. In standby mode or power-down mode, the drive power that is supplied from the small-power voltage-drop circuit 12*b* is consumed by the bit-line precharge voltage generating circuit 18. In standby mode or power-down mode, therefore, the drive power of the small-power voltage-drop circuit 12*b* is consumed, thereby suppressing a rise in dropped supply voltage Vddi for the input/output circuits.

(3) The memory core circuits 16 and the self-refresh oscillation circuit 19 are connected to the third internal supply voltage generating circuit 13. In standby mode or power-down mode, the drive power that is supplied from the small-power voltage-drop circuit 13*b* is consumed by the self-refresh oscillation circuit 19. In standby mode or power-down mode, therefore, the drive power of the small-power voltage-drop circuit 13*b* is consumed, thereby suppressing a rise in dropped supply voltage Vddc for the memory core.

(4) The third internal supply voltage generating circuit 13 stably generates the dropped supply voltage Vddc even when the external supply voltage Vext becomes equal to or lower than the data retention voltage. Therefore, the self-refresh oscillation circuit 19 receives the stable dropped supply voltage Vddc of 2.0 V and performs a stable oscillating operation.

(5) Because no leak elements are needed to suppress rises in the voltages on the internal power lines L1–L3 in standby mode or power-down mode, the circuit area is prevented from becoming larger.

(6) The internal supply voltage generating circuits 11, 12 and 13 are electrically independent and respectively generate the dropped supply voltages Vdd, Vddi and Vddc, which are different from one another. It is therefore possible to separately design the layout patterns of the internal supply voltage generating circuits 11, 12 and 13.

It should be apparent to those skilled in the art that the present invention may be embodied in many other specific forms without departing from the spirit or scope of the invention. Particularly, it should be understood that the invention may be embodied in the following forms.

Each of the peripheral function circuits 14, the input/output circuits 15, and the memory core circuits 16 may be separated into smaller circuits so that an internal supply voltage generating circuit is connected to each smaller circuit.

The present invention may be adapted to a semiconductor memory device or a semiconductor device that has two or four or more internal supply voltage generating circuits that generate different voltages.

The internal circuits, which are constantly driven, are not limited to the cell-plate voltage generating circuit 17, the bit-line precharge voltage generating circuit 18 and the self-refresh oscillation circuit 19, but may be other circuits which operate in standby mode or power-down mode, such as a power-on reset circuit that monitors the power supply.

The cell-plate voltage generating circuit 17 and the bit-line precharge voltage generating circuit 18 may be connected to a single internal supply voltage generating circuit.

Although the large-power voltage-drop circuits 11*a*, 12*a* and 13*a* and the small-power voltage-drop circuits 11*b*, 12*b* and 13*b* are preferably feedback type voltage-drop circuits, they may also be source-follower type voltage-drop circuits. That is, it is preferable to use voltage-drop circuits that generate stable dropped supply voltages with respect to the external supply voltage.

The present invention may be adapted not only to a SDRAM but also to other semiconductor memory devices.

The present invention may be adapted to a semiconductor device such as an MPU (Microprocessor unit) or a memory controller, as well as a semiconductor memory device.

Therefore, the present examples and embodiments are to be considered as illustrative and not restrictive, and the invention is not to be limited to the details given herein, but may be modified within the scope and equivalence of the appended claims.

What is claimed is:

1. A drive power supply method for a semiconductor device having an internal supply voltage generating circuit, the method comprising:

connecting first and second internal circuits to the internal supply voltage generating circuit, wherein the first internal circuit is inactivated in standby mode or power-down mode and is activated in active mode, and the second internal circuit operates in the standby modes the power-down mode and the active mode; and supplying drive power to the first and second internal circuits from the internal supply voltage generating circuit.

2. A drive power supply method for a semiconductor device having a plurality of internal supply voltage generating circuits, each including a first voltage-drop circuit for supplying relatively large drive power and a second voltage-drop circuit for supplying relatively small drive power, the method comprising:

connecting first and second internal circuits to at least one of the plurality of internal supply voltage generating circuits, wherein the first internal circuit is inactivated in standby mode or power-down mode and is activated in active mode, and the second internal circuit operates in the standby mode, the power-down mode and the active mode; and supplying drive power to the first and second internal circuit from at least the first voltage-drop circuit in the active mode; and supplying drive power to the second internal circuit from at least the second voltage-drop circuit in the standby mode or the power-down mode.

3. A semiconductor device comprising:

at least one internal supply voltage generating circuit for generating relatively small drive power in standby mode or power-down mode and generating relatively large drive power in active mode;

a first internal circuit that is activated and receives drive power from the at least one internal supply voltage generating circuit in the active mode and is inactivated in the standby mode or power-down mode; and a second internal circuit that operates by receiving drive power from the at least one internal supply voltage generating circuit in the standby mode, the power-down mode and the active mode.

4. A semiconductor memory device comprising:

at least one internal supply voltage generating circuit including a first voltage-drop circuit for generating relatively large drive power and a second voltage-drop circuit for generating relatively small drive power;

a first internal circuit that is activated and receives drive power from at least the first voltage-drop circuit of the at least one internal supply voltage generating circuit in active mode and is inactivated in standby mode or power-down mode; and a second internal circuit that operates by receiving drive power from the second voltage-drop circuit of the at least one internal supply voltage generating circuit in the standby mode, the power-down mode and the active mode.

5. The semiconductor memory device according to claim 4, wherein the second internal circuit is selected from the group consisting of a cell-plate voltage generating circuit, a bit-line precharge voltage generating circuit, an oscillation circuit, and a power-on reset circuit.

6. A semiconductor memory device comprising:

a plurality of internal supply voltage generating circuits, each including a first voltage-drop circuit for generating relatively large drive power and a second voltage-drop circuit for generating relatively small drive power;

a plurality of first internal circuits, each of which is activated and receives drive power from at least the first voltage-drop circuit of one of the internal supply voltage generating circuits in active mode and is inactivated the standby mode or power-down mode; and a plurality of second internal circuits that operate by receiving drive power from the second voltage-drop circuits of the internal supply voltage generating circuits in the standby mode, and the power-down mode and the active mode.

7. The semiconductor memory device according to claim 6, wherein the plurality of normally-driven internal circuits include a cell-plate voltage generating circuit, a bit-line precharge voltage generating circuit, and an oscillation circuit.

8. The semiconductor memory device according to claim 6, wherein the plurality of internal supply voltage generating circuits are electrically isolated from one another.

9. The semiconductor memory device according to claim 6, wherein the plurality of internal supply voltage generating circuits generate voltages that are different from one another.

10. The semiconductor memory device according to claim 6, wherein the plurality of first internal circuits include memory circuits, input/output circuits, and peripheral function circuits.

11. The semiconductor memory device according to claim 10, wherein the plurality of second internal circuits include a cell-plate voltage generating circuit, a bit-line precharge voltage generating circuit and an oscillation circuit, the plurality of internal supply voltage generating circuits include first, second, and third internal supply voltage generating circuits, and the peripheral function circuits and the cell-plate voltage generating circuit are connected to the first internal supply voltage generating circuit, the input/output circuits and the bit-line precharge voltage generating circuit are connected to the second internal supply voltage generating circuit, and the memory circuits and the oscillation circuit are connected to the third internal supply voltage generating circuit.

12. The semiconductor memory device according to claim 6, wherein the plurality of second internal circuits include an oscillation circuit, the plurality of internal supply voltage generating circuits generate voltages different from one another, and the oscillation circuit is connected to that one of the internal supply voltage generating circuits that generates a lowest voltage.

13. The semiconductor memory device according to claim 12, wherein the internal supply voltage generating circuit that generates the lowest voltage generates a voltage lower than a data retention voltage.

* * * * *